United States Patent [19]

Krans

[11] Patent Number: 4,503,795

[45] Date of Patent: Mar. 12, 1985

[54] SAILING CRAFT

[76] Inventor: Richard Krans, Rozenstraat 34, 6814 EG Arnhem, Netherlands

[21] Appl. No.: 578,609

[22] Filed: Feb. 13, 1984

Related U.S. Application Data

[63] Continuation of Ser. No. 305,899, Sep. 25, 1981, abandoned.

[30] Foreign Application Priority Data

Sep. 30, 1980 [NL] Netherlands ..... 8005425

[51] Int. Cl.[3] ..... B63H 9/04

[52] U.S. Cl. ..... 114/39; 114/61

[58] Field of Search ..... 114/39, 56, 61, 102, 114/103, 109–115, 89, 90, 97, 100, 101

[56] References Cited

U.S. PATENT DOCUMENTS

| | | | |
|---|---|---|---|
| 92,539 | 7/1869 | O'Neill | 114/100 |
| 95,442 | 10/1869 | Dryburgh | 114/100 |
| 1,295,732 | 2/1919 | Graham | 114/163 |
| 2,917,754 | 12/1959 | Gunderson | 114/61 |
| 3,173,395 | 3/1965 | Laurent | 114/39 |
| 3,223,065 | 12/1965 | Wilson | 114/39 |
| 3,304,899 | 2/1967 | Weatherly | 114/123 |
| 3,307,511 | 3/1967 | Chapman | 114/61 |
| 3,571,831 | 3/1971 | Conklin | 114/61 |
| 3,585,955 | 6/1971 | Cella | 114/61 |
| 3,985,090 | 10/1976 | Rineman | 114/123 |

FOREIGN PATENT DOCUMENTS

| | | | |
|---|---|---|---|
| 2337077 | 7/1977 | France | 114/39 |

*Primary Examiner*—Trygve M. Blix
*Assistant Examiner*—Jesûs D. Sotelo
*Attorney, Agent, or Firm*—Hopgood, Calimafde, Kalil, Blaustein & Judlowe

[57] ABSTRACT

A sailing craft (1) comprising a center cross-plane symmetric hull (2,3) and capable of sailing in either direction is disclosed herein. Good skimming properties are imparted to the sailing craft (1) by utilizing the principle of the normative angle of inclination based on the stability and the effectiveness of the sail and keel function of the craft, this being realized by designing the bottom side of the hull (1) as a substantially flat plane enclosing an angle of from 10° to 20° with respect to the plane of the water line and providing relatively deep draught keel-rudder (821,101) which are equidistant with respect to the center cross-plane and preferably a sail (10) which is isosceles in outline for having a relatively low point of pressure. Boom attachments (25,26) edging strainers (30) and an automatic trimming system may keep the sail (10) in the ideal profile thereof while balancing the pressure point and the lateral point.

4 Claims, 10 Drawing Figures

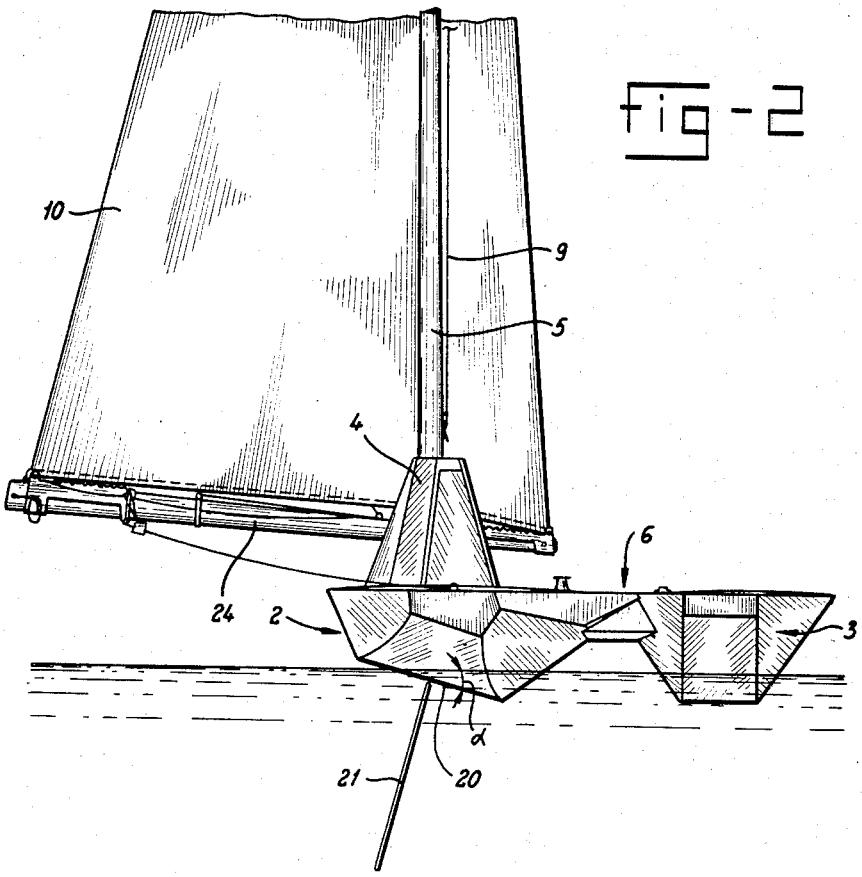
fig-2
fig-3
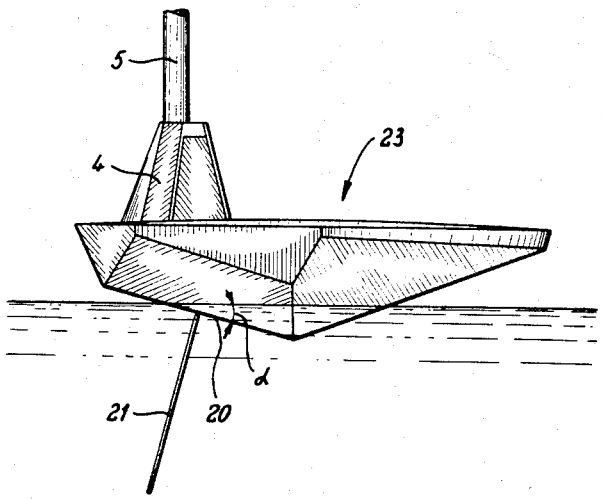

SAILING CRAFT

This is a continuation of application Ser. No. 305,899, filed Sept. 25, 1981, now abandoned.

The invention relates to a sailing craft comprising a centre cross-plane symmetric hull, a mast connected to said hull such that said mast or the extension thereof will intersect the line of intersection between the plane of the water line and the centre cross-plane at a point beyond the centre of this intersection, said mast being provided with means for securing a sail, and rudder means mounted symmetrically with respect to the cross-plane.

Such a craft is known from U.S. Pat. No. 3,985,090. Herein those parts of the hull at either side of the centre cross-plane represent the mirror image of each other contrary to a common vessel in which those parts of the hull at either side of the longitudinal centre plane constitute the mirror image of each other.

Stated differently the plane of symmetry of a common vessel is in sailing direction whereas in a craft of the above mentioned type the plane of symmetry is perpendicular to the sailing direction. Dependent on the direction of the wind a common sailing craft will be sailed over starboard or over port. A sailing craft of the above mentioned type will always be sailed over the same side either the one end or the other end serving as the bow.

The hull of the known vessel is sharp in order to prevent the leeward drift of the vessel due to which shape the hull will be less apt to skim over the water. Upon sailing the mast will always heel over more or less to the leeside causing the effectiveness of the vertical area of the sail to decrease more as the wind is stronger.

The object of the invention is to provide an improved sailing craft of the above mentioned type as regards the shape of the hull, the speed and the simplicity of handling.

According to the invention the above mentioned object is attained in that the bottom side of the hull is defined at least mainly by a substantially flat plane enclosing an angle of from 10° to 20° with respect to the plane of the water line, the line of intersection between said flat plane and the plane of the water line being at the same side of the centre of the intersection between the cross-plane and the plane of the water line as the said point of intersection between (the extension of) the mast and the latter line of intersection.

By the plane of the water line is meant the horizontal plane defined by the water line when the sailing craft is at rest and floats in quiet water.

By the vertical area of sail and the vertical area of keel is meant the vertical projection of the sail and the keel, respectively.

The above mentioned angle of from 10° to 20° is called the normative angle of inclination. This angle is based on the stability in association with the effectiveness of the sail and keel function determined by the vertical area of sail and keel as the reaction forces caused by the always horizontal forces of the wind. The keel is formed herein by blade-like rudder means. The principle of said angle turns to account two data i.e.: (1) When heeling over from the vertical position the vertical area decreases such that the decrease will be smaller at the outset than in heeling over further. (2) During sailing the craft will always heel over to one side. In case of little wind the sailing craft will hardly heel over and the vertical area of sail will remain the optimum. Due to the inclination the vertical area of keel will be somewhat smaller though only marginally. Where the position of the keel possesses some kind of dampening function the efficiency substantially equals the optimum. When the wind gains in force the vertical area of sail decreases gradually and in wind of increasing force the heel-over will go relatively less far but the keel function will yet remain substantially the optimum because the area thereof hardly becomes smaller.

The above principle applies only to keel blades having a relatively deep draught contrary to the known vessel in which the leeward drift is prevented by the acute shape of the hull. By applying said keel blades and utilizing the principle of the normative angle of inclination a favourable design may be imparted to the hull for achieving good skimming properties.

Preferably the rudder means are in the shape of a blade, the axis of rotation of which is perpendicular to said flat plane. For acquiring optimal properties it is preferred that the axis of the mast will perpendicularly intersect the plane of the water line if the craft is in position of rest.

Furthermore the sail is preferably isosceles in outline and may be secured to a boom, such that both the lowermost tips of the sail are fastened to boom attachments one of which is fixedly belayed to the boom and the other one is movable along the boom such that the edging may be strained or slackened by means of the edging strainer, it then being preferred moreover that the sheets may be connected to shackles which are being fastened to boom attachments and are movable on said boom attachments.

For a most favourable utilisation of the sail it is preferred that there is provided an automatic trimming system comprising a trimming line connected to the edging at approximately $\frac{1}{3}$ of the length of said edging with respect to one extremity thereof, said trimming line being fastened to the other end of the boom, and a trimming line connected to the edging at approximately $\frac{1}{3}$ of the length of said edging with respect to the other extremity thereof, said second trimming line being fastened to the said one of the boom, the one trimming line being tautened by means of the most forward sheet in sailing direction and the other one being slackened at the same time. The operation of this system is elucidated further below.

It is possible to construct the hull as a singular hull though it may be preferred to compose the hull of two longitudinal parts connected to each other, the part having the mast connected thereto being longer than the other part such that the water line of the one part does not intersect that of the other part.

The invention will be discussed in a detailed manner hereinafter with reference to the drawings, showing embodiments on different scale, in which FIG. 1 is a perspective view of an embodiment of the sailing craft according to the invention;

FIG. 2 shows a front elevation of the sailing craft according to FIG. 1;

FIG. 3 shows an other embodiment of the craft according to the invention;

Figure 9:
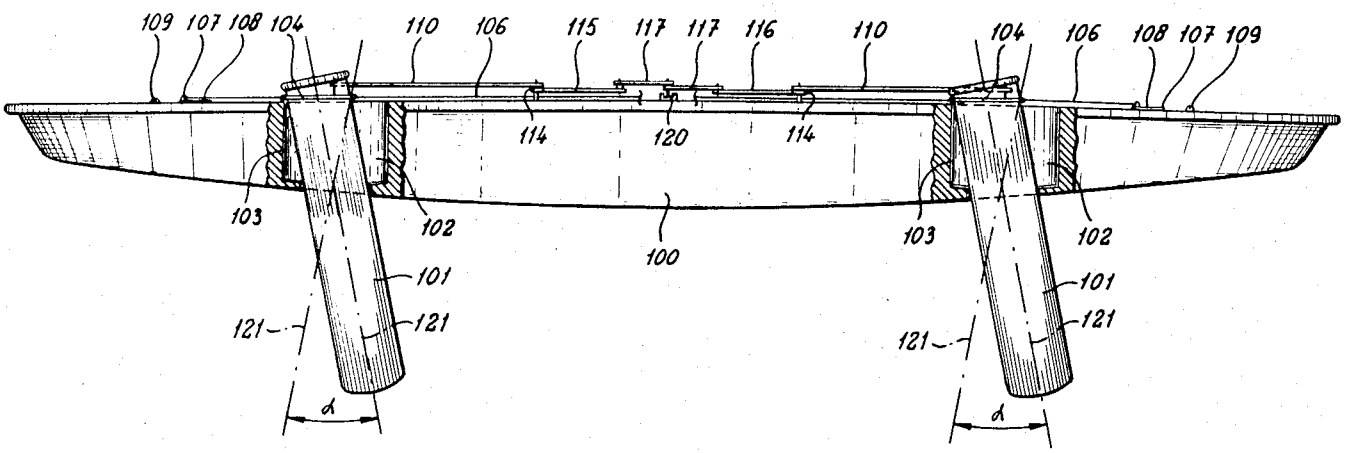
Figure 10:
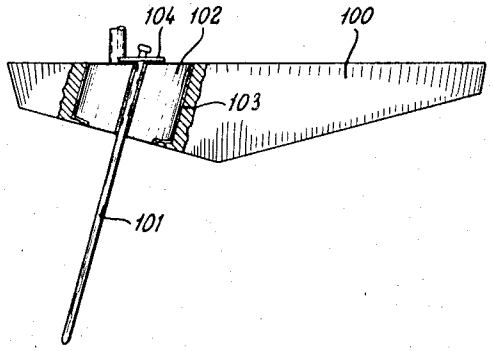

FIGS. 8, 9 and 10 show an example corresponding to FIG. 3 of an improved embodiment of the steering device, in which except for the location of the mast that part of the vessel present above the deck has been omitted entirely and wherein FIG. 8 shows a plan view of the sailing craft according to the invention, FIG. 9 shows a side elevation partially in cross section end FIG. 10 shows a front elevation partly in cross section.

Figure 1:
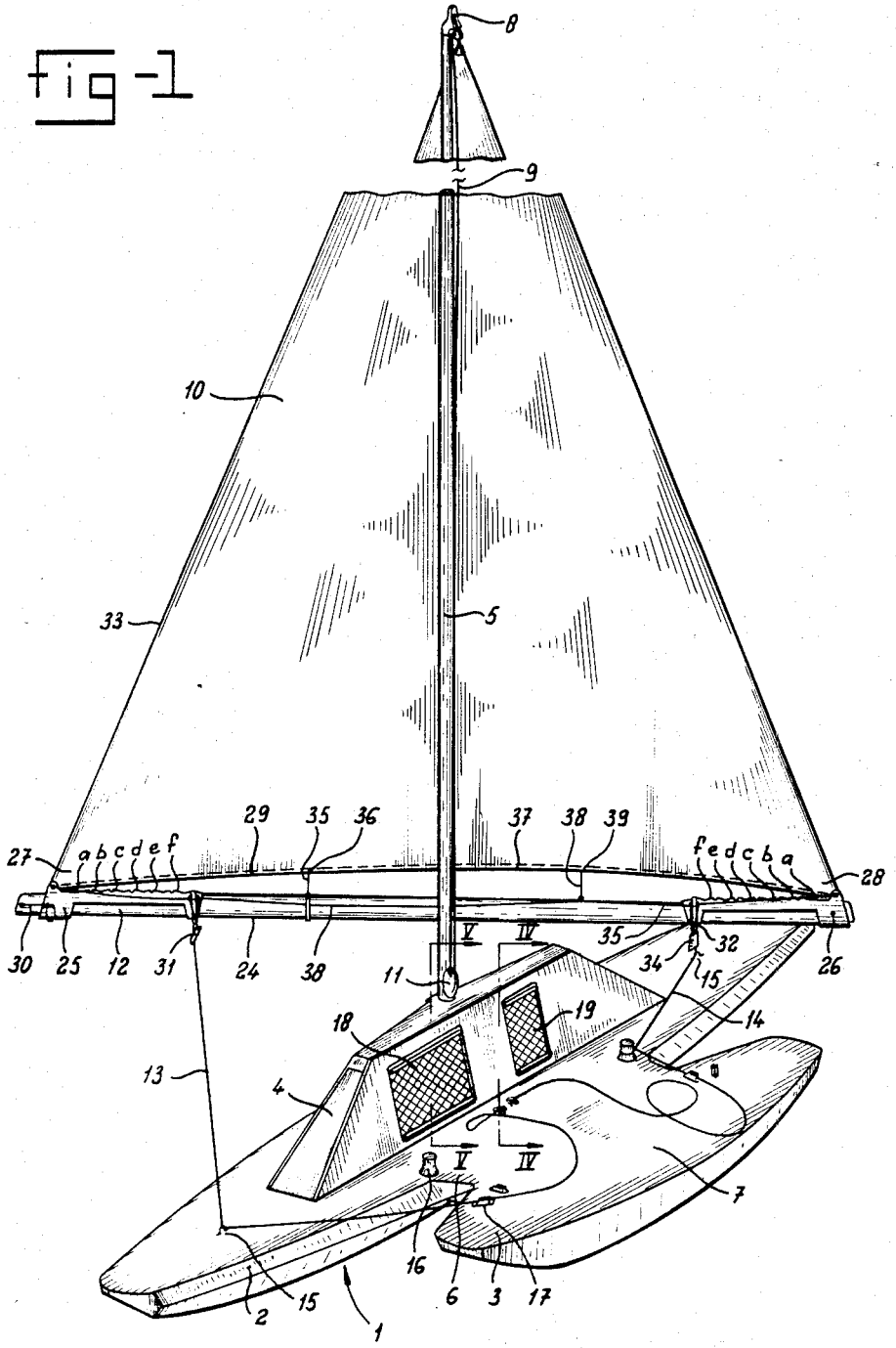
Figure 4:
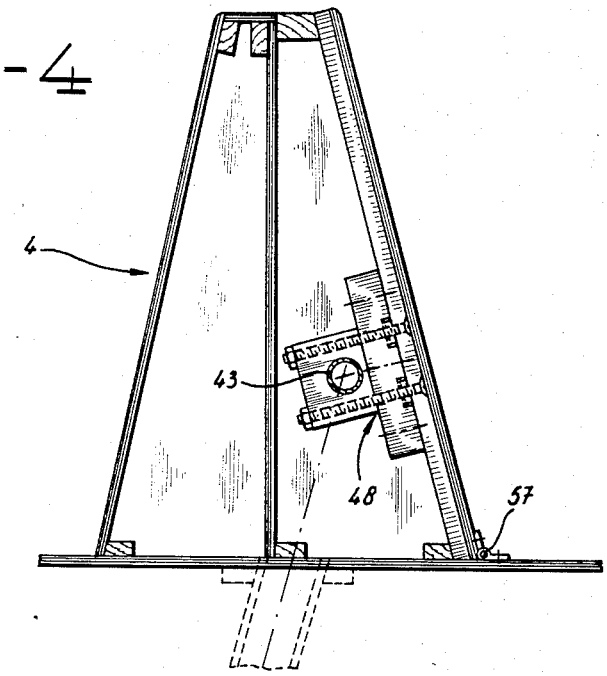
FIG. 4 shows a cross section along the line IV—IV in FIG. 1.

With reference to FIGS. 1 and 2 the sailing craft 1 according to the invention comprises a hull composed of two hull parts 2 and 3. On the deck of the hull part 2 there is provided a steering box 4 accommodating the steering mechanism to be discussed hereinafter and also receiving the mast 5. Between the hull part 2 and the hull part 3 there is provided a junction 6 which together with the hull part 3 constitutes the position or seat 7 to be taken by the sailor. The head 8 of the mast 5 is connected to a sail 10 which may be hoisted or lowered by means of a halyard 9 which halyard 9 may be fastened to the bottom of the mast 5 at 11. The lower edge of the sail preferably being isosceles in outline is connected to a boom 12 to be described hereinafter. Sheets 13 and 14 are connected to the boom 12, said sheets being guided to seat 7 of the sailor by way of proper means, such as shackles 15, rollers 16 and belaying means 17. The side of the steering box 4 comprises two treadles 18 and 19 upon which a seated sailor places hit feet for operating the steering mechanism to be discussed hereinafter.

As will be clearly apparent from FIG. 2 the hull part 2 is designed such that a skimming plane 20 is formed enclosing an angle $\alpha$ with respect to the surface of the water when the sailing craft and the water are quiet. Here this angle $\alpha$ is 15° though in general it will be between 10° and 20°. Like already discussed above this angle is called the normative angle of inclination. Dependent on the force of the wind during sailing the sailing craft (when viewed in FIG. 1) will heel over to the left, whereby the hull part 3 will be lifted more or less out of the water—to a certain extent dependent on this heel over—causing the skimming plane 20 to acquire more and more the most favourable position for skimming. Like described above the most favourable position of the sail 10 is reached at a heel over between 10° and 20°.

The sailing craft is provided with rudder means 21, the axis of rotation of which is perpendicular to the skimming plane 20, which rudder means are at equal distance at either side of the centre cross-plane. The rudder means 21 are in the shape of a blade. The said axis of rotation is also the axis of symmetry of said blade-like means 21. The blade-like means furthermore function as keel surfaces for controlling the leeward drift of the sailing craft.

With reference to FIG. 2 there is shown a sailing craft having two hull parts 2 and 3. However it is also possible to construct the sailing craft such that she will have only one hull part 23 like shown in FIG. 3.

Like stated above the lower edge of the sail 10 is connected to a boom 12. This boom 12 consists of a spar 24 the ends of which are provided with boom attachments 25, 26 to which the lowermost tips 27, 28 of the sail are belayed. One of the boom attachments 25 is movable along the boom, whereas the other one 26 is fixedly belayed. The edging 29 of the sail may be strained or slackened by means of the edging strainer 30. As has been mentioned the sheets 13, 14 are connected to boom shackles 31, 32 which boom shackles on their turn are fastened to the boom attachments 25, 26 and which are adjustable thereon in the positions a to f, inclusive, the position a being close to the point where the sail 10 is fastened to the boom attachments 25, 26.

The operation of the boom attachment is as follows:

The formost sheet in sailing direction (the sheet 14 in FIG. 1) is tautly belayed.

When the force of the wind increases the boom attachment is belayed from a to f. 'a' is the light wind position and 'f' is the strong wind position.

Shifting from a to f entails also the following:

1. The point of pressure on the sail is moved to the front. (Due to positioning the guide-loop 15 for the sheet on the deck, in combination with the mast support of the sail and the bending of the mast the point of pressure on the sail is also moved to the front over a fixed distance.)

Where at increasing wind force and hence increasing speed the lateral point (the point of downward thrust) moves to the front there will be a continuously adjustable balance between the point of pressure on the sail and the lateral point. Thereby the stability in sailing direction is guaranteed (no increase in weather- or in lee-helm) this being conducive to a gain in efficiency.

2. The boom is kept in check. The boom cannot freely flap up and down. When the force of the wind increases the force keeping the boom in horizontal position will increase too.

3. Due to the force keeping the boom down the sail will also be pulled in a more flat condition (this being adjustable due to the association thereof with the edging strainer and the trimming system to be discussed hereinafter).

4. Upon increasing force of the wind the front stay 33 is tensioned more tautly. Because the largest area of sail is to be found behind the line: fixed sheet 14—head of the mast 8, there will occur a draining action causing tautening the front stay 33.

The operation of the trimming system is as follows:

This adjustable automatic trimming system provides for an approximation of the ideal profile of the sail.

This sailing craft design does not allow for tailoring and/or straining the sail in accordance with the ideal profile (wherein the strongest convexity is at $\pm\frac{1}{3}$ to the front) because upon changing the sailing direction fore and aft are reversed so that it is necessary to install this system. The operation is based on the angular differential between boom shackle and sheet between the fixedly belayed sheet 14 and the handling sheet 13.

Due to the horizontal position of the fixedly belayed sheet 14 the trimming line 35 is tautened by means of the draining action of trimming plate 34 whereby the sail is pulled at point 36. (Because the other end of the trimming line is fastened to the boom attachment where the sail is attached.) The force exerted on the sail by the trimming line 35 at point 36 is transferred to the back part of the edging of the sail by means of the sailing lath 37, thus causing the ideal profile to be formed. Due to the relatively more vertical position of the handling sheet the trimming line 38 is slackened, whereby the point 39 on the sail may freely swing outward.

Apart from the operation of the sail the plan of sails is yet subject to an additional condition in view of the heel. The entire sailing craft design is selected among others for acquiring a low point of pressure on the sail, thus creating a favourable stability which may be utilized for carrying a relatively larger area of sail accompanied by all the advantages thereof. This implies however also that the boom will occupy a very low level. Upon heeling over and swinging out the boom one would accordingly run the risk that the boom will rather soon hit the water and cause all disadvantages thereof. In the sailing craft according to the invention this has been solved in that the sail rotates about the line: head of the mast 8—fixedly belayed sheet 14. The fixedly belayed sheet now takes a position relatively far to the front. Consequently the boom—when swinging out—rises at the same time and may accordingly be kept above the water.

Where the principle of the angle of inclination implies that sailing is performed at an inclination (last but not least in view of the skimming plane) it is hence necessary that such is permitted by the plan of sails, like is the case in the sailing craft according to the invention. Likewise one might arrange the sail at a higher level but such would again undo the advantage of the low point of pressure on the sail.

It has already been stated above that use is made of keel blades functioning at the same time as rudder means: These means are operated by the sailor by working the threadles 18,19. As has been shown in FIGS. 6 and 7 the rudder-keel blades 21 are of symmetric design with respect to the rotation axis 39 and as will be evident from FIG. 7 the rudder-keel blades 21 are arranged at equal distance from the centre cross-plane at either side thereof. The whole may be lowered through a slot in the skimming plane of the vessel whereby the frame 40 will come to rest in grooves in the hull 2 (not shown). The frame 40 includes a framing part in which the shaft 39 is rotatably mounted in bearings 41 and 42. At the top this shaft has been coupled to the hollow shaft 43 by means of a transmission to be described below said hollow shaft furthermore being connected to the threadles 18, 19.

Figure 5:
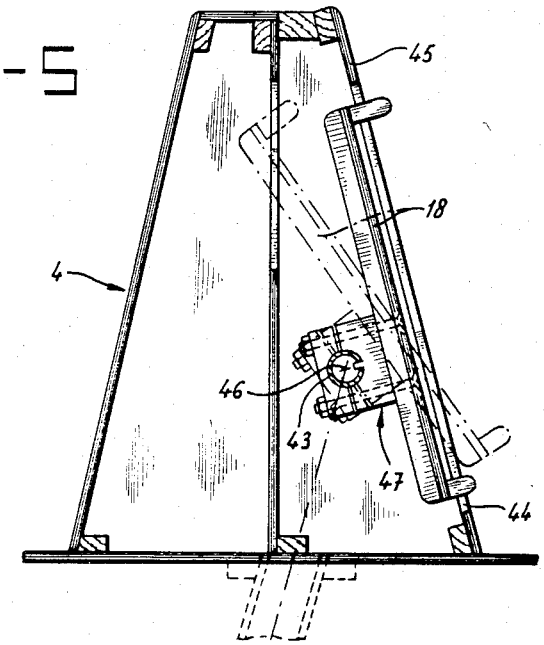
FIG. 5 shows a cross section along the line V—V in FIG. 1.

Like has been shown in FIG. 1, the threadles 18, 19 are mounted in openings 44 in the wall 45 of the steering box 4 facing the sailor as is shown in FIG. 5, the arrangement being such, that the sailor by means of his feet may rotate the threadles about the axis 46 of the bearing means 47, 48 (in FIG. 5) arranged within the steering box 4. The shaft 43 is rotatably mounted in the said bearing means 47, 48 (in FIG. 5) which may be of a design known per se. When activating the threadles 18, 19, the shaft is rotated over a certain distance, this rotation being transmitted by the shaft 43 to said transmission at the top of the shaft 39 and so to the keel or rudder blade 21.

Figure 6:
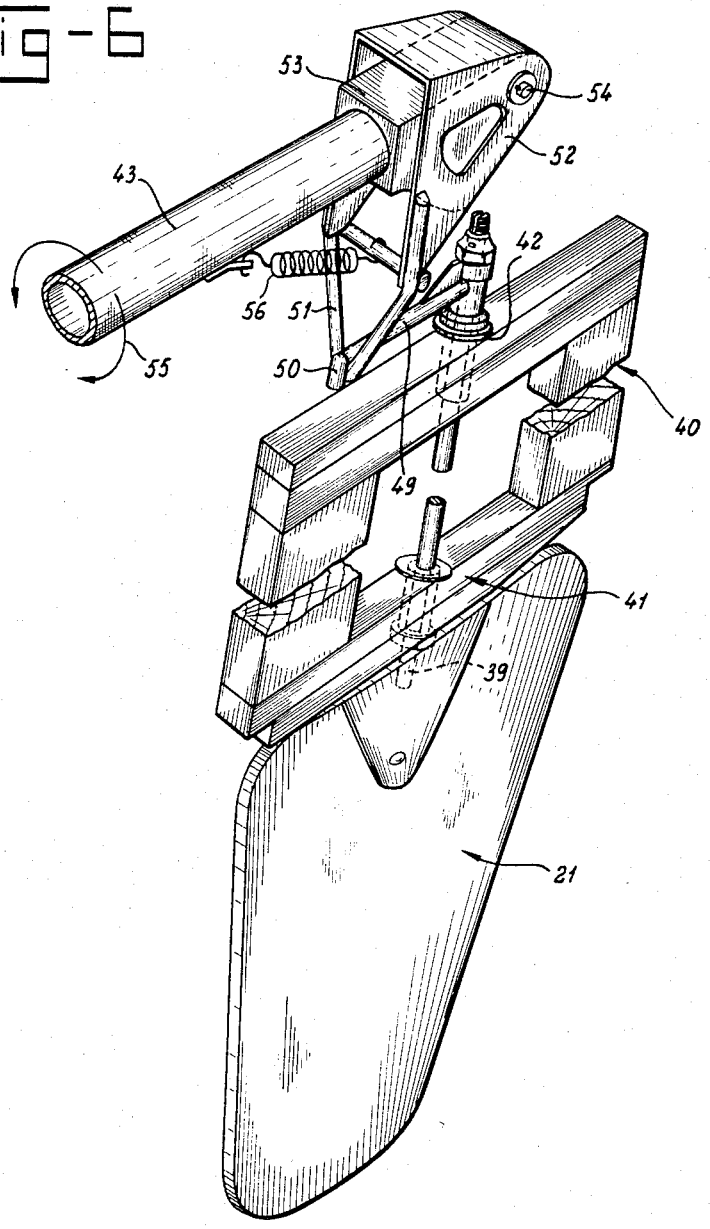
FIG. 6 shows the rudder means in detail as employed in the sailing craft according to the invention.
Figure 7:
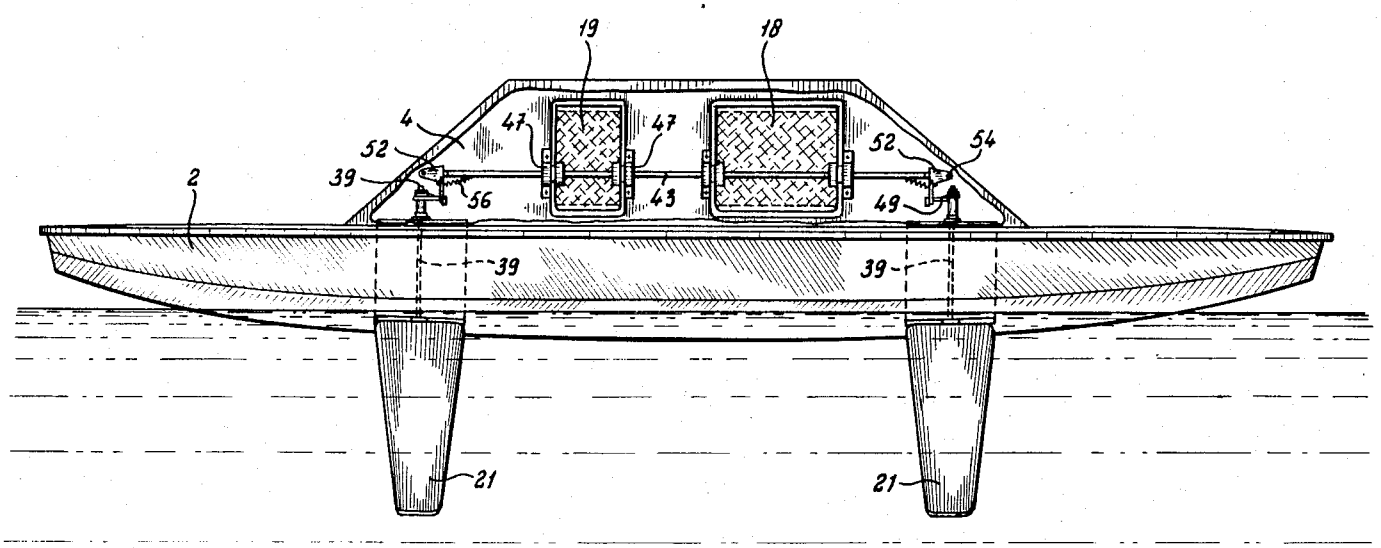
FIG. 7 shows a side elevation from the left in FIG. 1 of the sailing craft according to the invention, wherein the mast as well as the sail and accessories have been omitted and in which the wall of the steering box is broken away.
Figure 6:
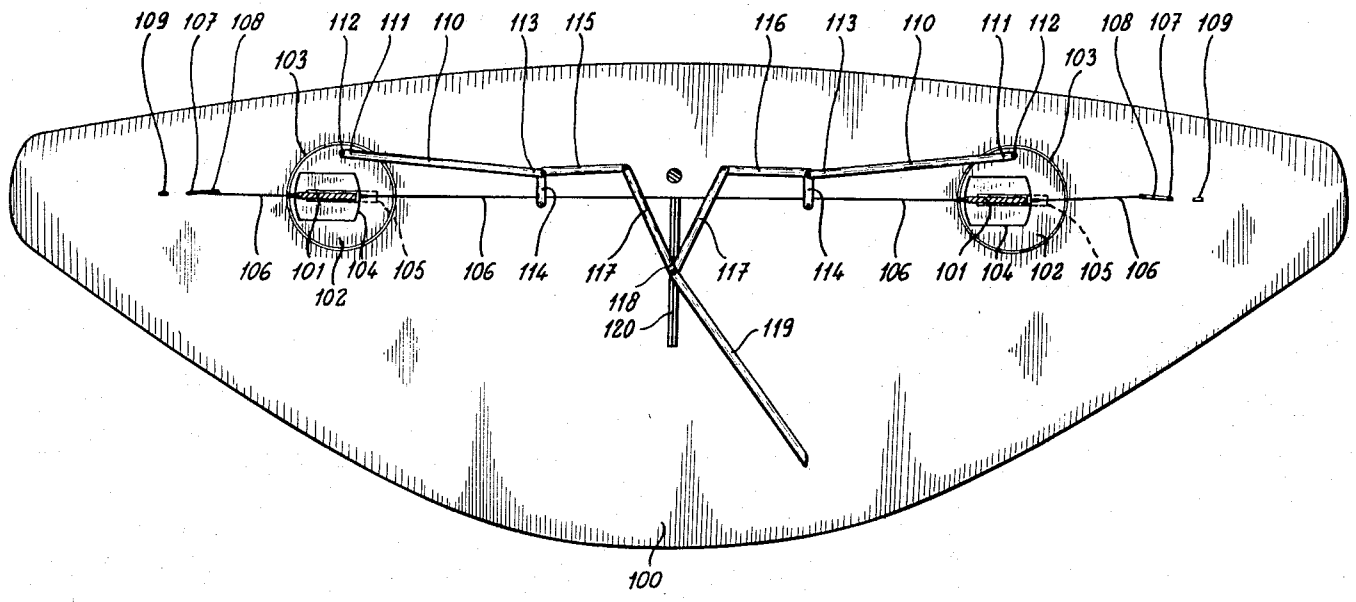

To the top of the shaft 39 there is connected a "helm" 49, the free end 50 of which is connected to the top of a V-shaped means 51, the latter being connected to a box shaped means 52 by means of welds or otherwise. The shaft 43 extends to nearby said means 52 and is provided at this extremity of a means 53 arranged within the box shaped means 52. The two last mentioned means 52 and 53 are hingedly connected to each other by means of a spindle 54. If now the shaft 43 is rotated in the direction of the arrow 55 (FIG. 6) the free end 50 of the helm 49, as viewed in FIG. 6, is turned to the left and consequently also the rudder blade 21. Accordingly the means 52 is forced to hinge downward about the spindle 54 because the helm 49 may only be swung in a plane perpendicular to the shaft 39. This movement of the means 52 with respect to the means 53 occurs until the top part of the means 52 will come in engagement with the means 53. The spring 56 is a homing spring endeavouring to reset the means 52 and 53 in the starting position thereof like indicated in FIG. 6.

For gaining accessibility to the driving mechanism of the rudder-keel means 21 part of the wall of the steering box 4 has been hingedly fastened at 57 to said box.

It has been found in practice that the examplary embodiment described above is difficult to handle so that the envisaged goal may not be reached in a completely satisfactory manner. It has been found in particular that the design is too sophisticated for many sailors and fails.

The examplary embodiment to be described hereinafter is of simple design and better controllable while there is also provided a certain coupling between the different operations.

In the drawing the examplary embodiment has been depicted for sailing into the direction of the left hand side.

In the deck 100 there is provided for each one of the rudder blades 101—a cylindrical box 102 which is rotatably mounted in a cylindrical opening 103 extending through the entire height of the whole of the sailing craft. The rudder blade 101 is connected to the box 102. A rudder reversal ring 104 is mounted at the top of the box 102. In the top of the box 102 there is provided a slot 105 in which the top of the rudder blade 101 may be moved back and fort as will be described hereinafter. Connected to the rudder reversal ring 104 there is provided a rudder reversal line 106 for coupling the two reversal rings 104, said rudder reversal line 106 extending from the opposite sides of the reversal rings 104 to a slide 107 adapted to run on a rail 108. This slide 107 is connected to the end of a not shown sheet running through the loop 109 to the relative tip of the not shown sail (vide FIG. 1 sheet 13 or 14, respectively).

Furthermore the top of the box 102 is connected to a rod system comprising a rod 110 connected at its one end 111 to an eccentric point 112 hingedly mounted to the box and at its other end 113 to the junction of the arms 114, 115 of a bell crank lever 116, the latter being hingedly connected to the deck 100 by way of its arm 114 and being hingedly connected at its other end to a straight rod 117 which together with its other end 118 is hingedly connected to a helm 119. The last mentioned hinge joint 118 is slidably mounted in a straight guide 120 provided in the centre cross plane of the sailing craft on the deck 100. This design has the special advantage that the rudder blades may be adjusted at any desired level and may be pulled up quickly.

As has been mentioned above FIGS. 8 and 9 represent the sailing craft while sailing in a straight course to the left hand side of the drawing. For sailing to the right hand side the rubber blades 101 have to be swung over an angle $\alpha$ of about 20° at maximum. When turning the rudder blades have to be rotated about their axis 121, that is to say corresponding to the changed position of the sail. When reversing from sailing to the left to sailing to the right the position of the sail has to be changed. To that effect the sheets 13, 14 connected to the slides 107 have to be operated whereby swinging from the position shown in FIG. 9 to the position swung over an angle $\alpha$ occurs simultaneously. Accordingly there is a direct coupling between the change in position of the sail and swinging the rudder blades. If a curved course has to be sailed the rudder blades are rotated about their axis in the opposite direction. This is effected by pushing the helm (as viewed in FIG. 8) in the direction to the top or pulling the same in the direction to the bottom of the drawing, respectively. This movement of the helm is transmitted—by means of the above described rod system—to the boxes whereby said boxes are caused to rotate in the associated cylindrical opening 103 till the desired position of the rudder blades is reached.

The material used for the several parts is corrosion resistant, preferably plastic material either reinforced or not or a metal coated with plastic material. Self lubricating materials or water lubricated materials are preferred therein.

In comparison with the first embodiment a simplification of the steering system is obtained whereby failure is largely prevented.

It will be clear that many embodiments of the present sailing craft and parts thereof, respectively, are within the scope of the invention when starting from the normative angle of inclination like defined above.

Moreover it will be clear that the present invention provides a new type of sailing craft utilizing most favourably the possibilities created by the application of the normative angle of inclination.

Finally it will be clear that an efficiency as high as possible is achieved by the sailing craft according to the invention.

I claim:

1. A sailing craft comprising:

a center cross-plane symmetric hull having a mast connected thereto such that the mast or the axis thereof intersects the line of intersection between the plane of the water line and the center cross-plane at a point beyond the center of said intersection, said mast being provided with means for securing a sail, including a boom and sheets connected thereto for controlling said sail, a pair of rudders mounted symmetrically with respect to the cross-plane, the bottom side of said hull being characterized at least mainly by a substantially flat plane inclined at an acute angle of from 10° to 20° with respect to the water line, the line of intersection between said flat plane and the plane of the water line being at the same side of the center of the intersection between the cross-plane and the plane of the water line at the point of intersection between the axis of the mast and the line of intersection formed between the cross-plane and the plane of the water line, the longitudinal axis of said rudders being coaxial to the axis of rotation of each of said rudders and being perpendicular to the inclined flat plane of said hull.

2. The sailing craft of claim 1, wherein the axis of the mast perpendicularly intersects the plane of the water line when the craft is at rest.

3. The sailing craft of claim 1, wherein said boom comprises a spar at the ends of which are provided boom attachments to which are fastened boom shackles, said sheets being connectable respectively to said boom shackles which are moveably adjustable on said boom attachments.

4. A sailing craft comprising:

a center cross-plane symmetric hull having a mast connected thereto such that the mast or the axis thereof intersects the line of intersection between the plane of the water line and the center cross-plane at a point beyond the center of said intersection, said mast being provided with means for securing a sail, including a boom and sheets connected thereto for controlling said sail, rudder means mounted symmetrically with respect to the cross-plane, the bottom of said hull being characterized at least mainly by a substantially flat plane inclined at an acute angle of from 10° to 20° with respect to the water line, the line of intersection between said flat plane and the plane of the water line being at the same side of the center of the intersection between the cross-plane and the plane of the water line at the point of intersection between the axis of the mast and the line of intersection formed between the cross-plane and the plane of the water line, a sail mounted on said mast and connected at its lower edging to said boom at the extremities of said edging, and a trimming system including a first trimming line connected to said lower edging at approximately $\frac{1}{3}$ of the distance from one end of said edging and fastened to one end of said boom, and a second trimming line connected to said lower edging at approximately $\frac{1}{3}$ of the distance from the other end of said edging and fastened to the other end of said boom, one of said trimming lines being held taut by means of the most forward sheet in the sailing direction, while the other of said trimming lines is maintained in the slackened state.

* * * * *